US006205944B1

(12) United States Patent
Dierksen et al.

(10) Patent No.: US 6,205,944 B1
(45) Date of Patent: Mar. 27, 2001

(54) BOAT MOORING ASSIST APPARATUS

(76) Inventors: Paul B. Dierksen, 4296 Colerain Ave.; Dale E. Dempsey, 255 E. Kelso Rd., both of Columbus, OH (US) 43202

( * ) Notice: Subject to any disclaimer, the term of this patent is extended or adjusted under 35 U.S.C. 154(b) by 0 days.

(21) Appl. No.: 09/522,741

(22) Filed: Mar. 10, 2000

(51) Int. Cl.[7] ..... B63B 21/00
(52) U.S. Cl. ..... 114/230.1; 114/230.15
(58) Field of Search ..... 114/230.1, 230.15

(56) References Cited

U.S. PATENT DOCUMENTS

| | | | | |
|---|---|---|---|---|
| 2,552,424 | * | 5/1951 | Gorman | 114/230.1 |
| 2,907,294 | * | 10/1959 | Lawler | 114/230.1 |
| 4,817,551 | * | 4/1989 | Matson | 114/230.15 |
| 5,499,591 | * | 3/1996 | Chippas | 114/230.15 |

* cited by examiner

*Primary Examiner*—Stephen Avila
(74) *Attorney, Agent, or Firm*—Robert E. Stebens

(57) ABSTRACT

This specification discloses an apparatus for assisting in mooring of a boat. The apparatus includes a strut support assembly designed to secure the apparatus to a dock post, and elongated strut secured at it's one end to the support assembly and a hook attached to it's opposite end. A clamping mechanism is incorporated in the support assembly to removably secure it to a vertically oriented dock post at a desired elevation. The strut comprises an elongated, rigid tube and a tension spring disposed interiorally of the tube in axially extending relationship with it's one end secured to the support assembly. When unextended, the opposite end of the spring terminates at the outter end of the tube. An elongated strut connector extends between the support assembly and the struts tube and functions to maintain the strut in a horizontal plane. The hook is pivotally connected to the outermost end of the spring to swing in a plane aligned with the struts longitudinal axis. An flexible limit connector extends between the support assembly and the strut. It's opposite end is secured the hooks connection with the spring and functions to limit outward extension of the spring. The hook as a U-shaped loop at it's lower end designed to engaged a boat's rail to restrict drifting of the boat away from the dock.

15 Claims, 4 Drawing Sheets

BOAT MOORING ASSIST APPARATUS

This invention relates, in general, to apparatus that assists a boat's operator to single-handedly mooring a boat to a dock. It relates more specifically to apparatus that is fixed to a docks post and automatically engages with a boat's rail as the boat is maneuvered into parallel relationship to the dock. This apparatus hooks onto the rail at the bow and functions to limit the distance to which the bow may tend to move away from the dock as a consequence of either wind or water currents.

BACKGROUND OF THE INVENTION

Docking and mooring of boats, particularlly those of a length that may be of the order of twenty or more feet. While the boat operator will be successful in bringing the boat into close, adjacent parallel relationship to the dock and can moor the aft end to a dock post or to a mooring cleat on the dock, as a first step in the mooring operation, a problem is frequently encountered in accomplishing mooring of the bow. This problem is created by either wind or water currents that may exist at any particular time as they may result in the bow of the boat drifting away from the dock while the stern is being moored. In severe cases, the wind and water currents may cause the bow to drift a sufficient distance from the dock as to be out of reach of the operator.

A common technique to avoid this problem has been to have a second person available to either merely catch the bow and hold it or to also utilize a mooring line to secure the bow while the boat's operator is accomplishing mooring of the aft end. Another technique that is utilized is the boat's operator uses a long handled hook to reach a railing that may be positioned on the bow and pull the bow back to the dock. This technique is successful depending on the distance that the bow moves away from the dock and length of the available boat hook.

SUMMARY OF THE INVENTION

In accordance with this invention an apparatus is provided for automatically engaging the boat's rail when the operator is maneuvering into parallel relationship to the dock and resist drifting movement of the bow away from the dock. This apparatus includes a strut which is mounted on the dock to extend over the water and has a hook secured to it's outer end. This hook is normally disposed in a vertical position with it's upper end pivotally secured to the strut for swinging movement in a plane that is parallel to the longitudinal axis of the strut. The hook is designed to engage with the boat's rail. It is adapted to slide over the rail as the boat is maneuvered into position adjacent to the dock. The strut is located at a vertical position which is above the rail with the hook's lower end below the rail whereby it will be caused to swing and slide over the rail. After the hook has passed over the rail, the lower end of the hook again swings to a vertical position. At this time, any movement of the bow may result to the rail becoming mechanically engaged with the hook.

A tension spring is disposed in the strut and mechanically interconnects the hook with a retaining element secured to a mounting structure attached to the dock. This spring enables the hook to be pulled outwardly from the strut in a situation where they wind/water currents are excessive causing the boat's bow to be displaced a greater than the distance which a person could reach and grab the boat's rail.

A strut support assembly is provided to enable removable positioning of the apparatus on a mooring post incorporated in a dock structure. The strut is secured at it's one end to this assembly. A first connecting element which consists of a length of chain is secured to the support assembly at a distance above the point of connection of the strut with it's opposite end secured to the strut at a point axially outward from the strut connection to the support assembly. This results in maintaining the strut in a horizontal position. A second connecting element that is greater than the first is also connected at it's one end to the support assembly closely adjacent that of the first connecting element with the opposite end connected to the outer end of the struts tension spring. It functions to limit the maximum extent to which the bow may move away from the dock.

These and other objects and advantages will become more clearly apparent from the following detailed description of an illustrative embodiment of the apparatus and the accompanying drawings.

DETAILED DESCRIPTION OF THE ILLUSTRATIVE EMBODIMENT

Figure 1:
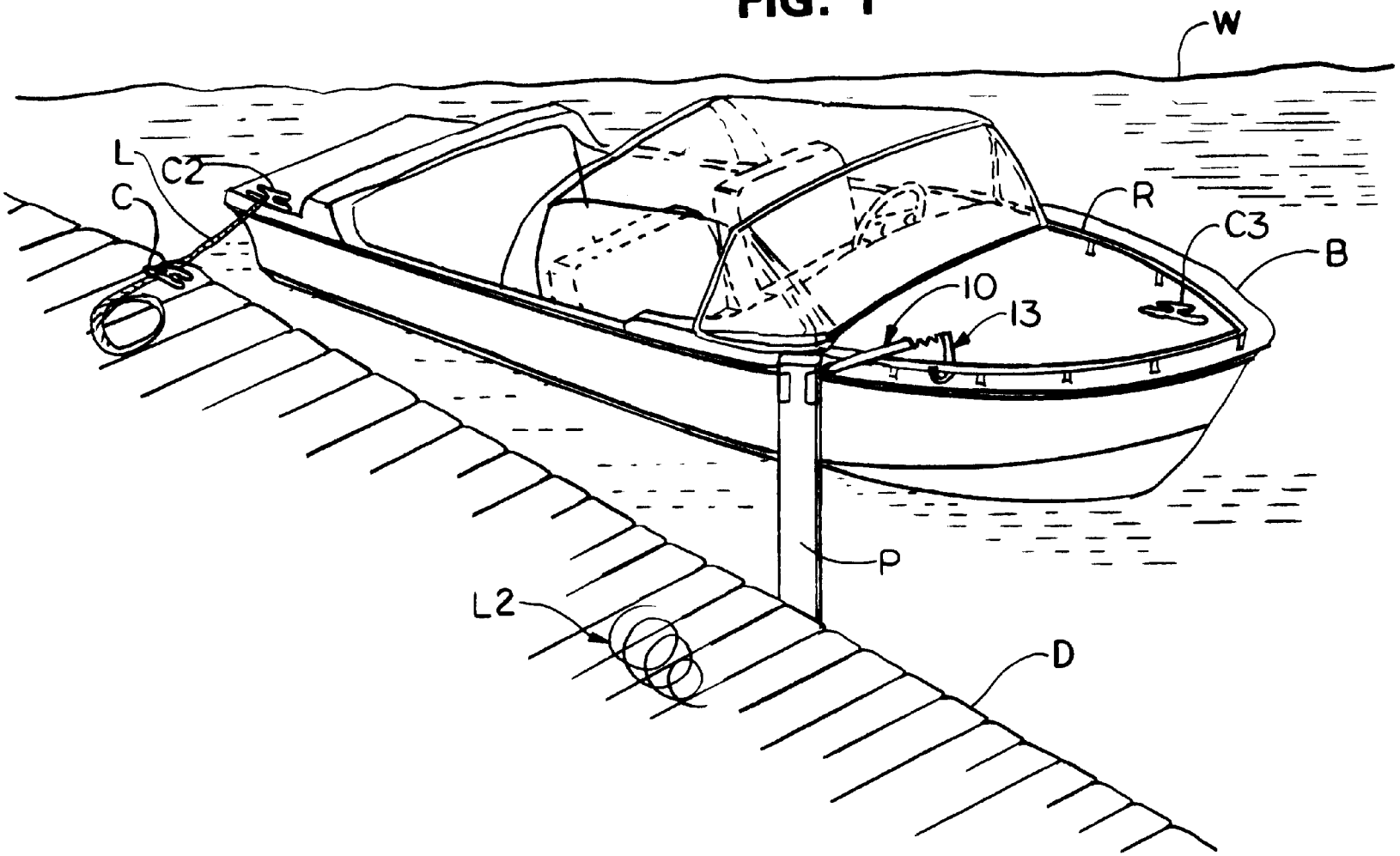
FIG. 1 is a perspective view of the apparatus in operative relationship to a boat.

Referring to FIG. 1, an embodiment of this invention, designated generally by the numeral 10, is shown mounted on the dock D in operative relationship to a boat B. This boat is shown floating on a body of water W in a position for being moored to the dock. As shown in FIG. 1, the aft is shown secured to a cleat C attached to the dock by a line L that extends to and is secured to a second cleat C2 attached to the boat. The bow of this boat is provided with a rail R and which extends around the bow close to the sides of the boat and is supported on posts secured to the boat's deck and to the rail. It is this rail with which the docking apparatus of this invention functions in facilitating mooring of the boat. The functioning of this apparatus in performance of a boat docking operation will be subsequently explained in detail.

Figure 2:
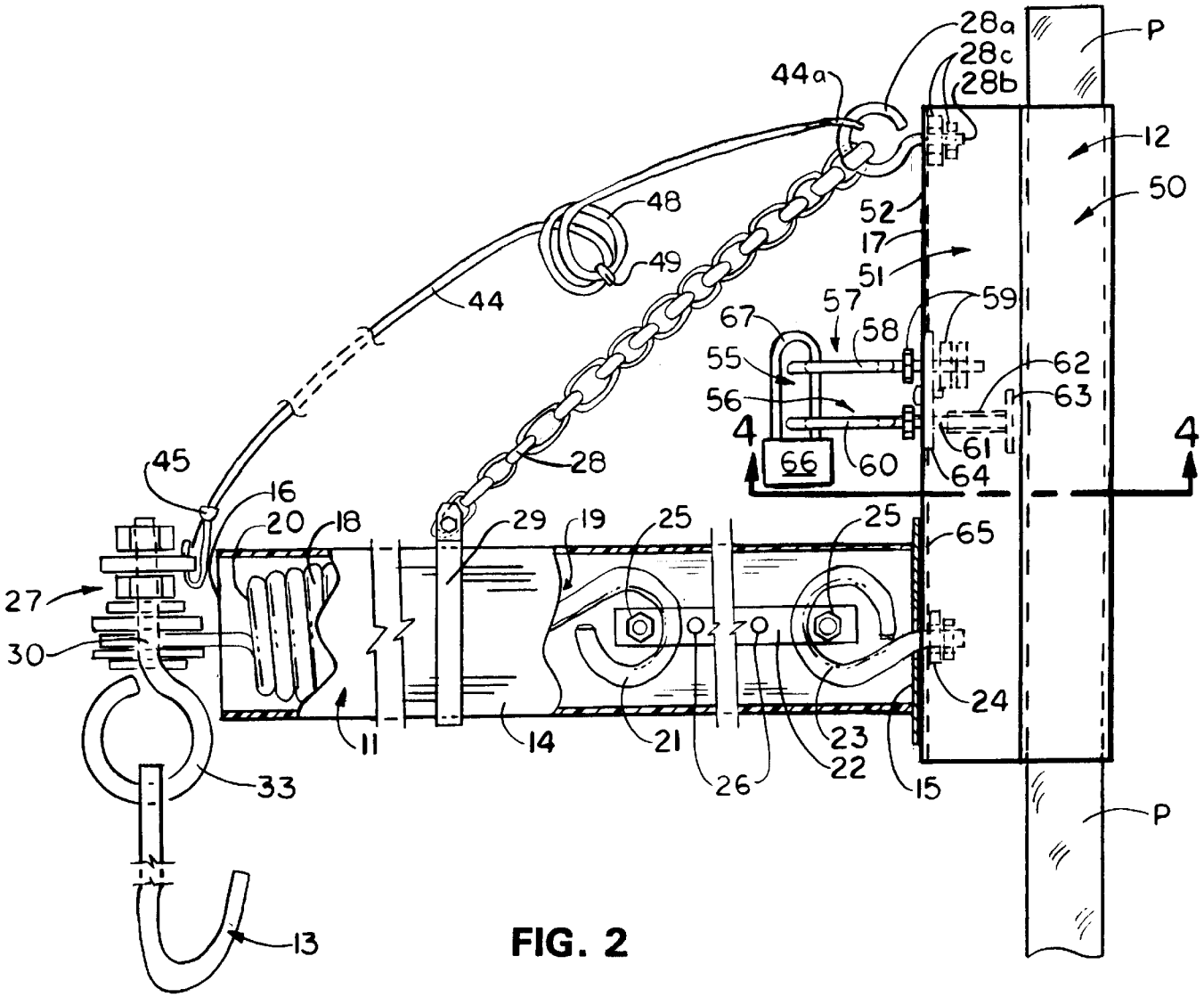
FIG. 2 is a side elevational view of the apparatus with portions of the structure broken away for clarity of illustration of certain components of the apparatus.
Figure 4:
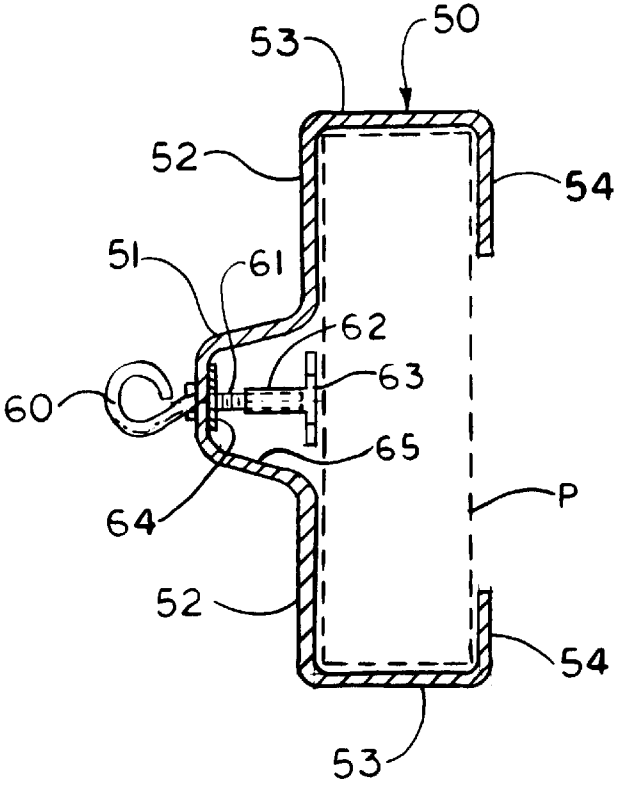
FIG. 4 is a sectional view taken along line 4—4 of FIG. 2.
Figure 3:
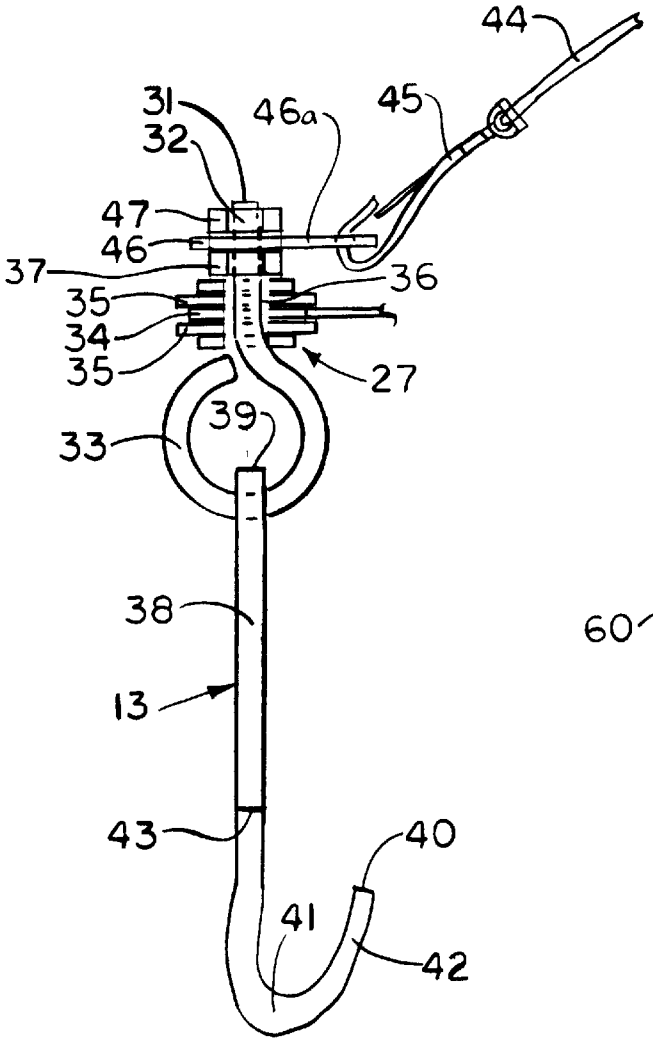
FIG. 3 is a side elevational view of the hook assembly.

The structure of the docking apparatus is best shown in FIG. 2 and this portion of the description is reference to that drawing figure. The apparatus comprises three major components which are designated as an elongated strut 11, a strut support assembly 12 and a hook 13. These components are design to be mounted on the vertical post P which is incorporated into structure of the dock D. The support assembly comprises an elongated channel which is positioned on and secured to the post. It is advantageously fabricated from metal, such as steel, and having adequate structural strength to perform it's function.

Adapted to be mounted on the support assembly 12, is the elongated strut 11. This strut includes a tube 14 having first and second ends 15 and 16 with the first end mechanically fitted against a vertical surface 17 of the support assembly. It is of a length in the range of 2½ to 3 feet and is disposed in a substantially horizontal plane extending latterly outward from the dock and over the adjacent water. Disposed interiorly of the tube is an elongated tension spring 18 having a first end 19 disposed adjacent the first end of the tube. A second end 20 of this spring is located adjacent the struts second end and is normally enclosed within the strut but will be extended out of the strut during the course of a mooring operation. The first end 19 of the tension spring 18 is secured to the support assembly 12. Securing of the spring is effected by a loop 21 is integrally formed at this end of the spring and which is mechanically secured to the support assembly by means of a pair of spaced parallel rigid pair of connector links 22 which extend axially though the tube and are connected to an eye bolt 23 having a screw threaded shaft which extends though the wall of the support assembly 12 and is fixed there to by a nut 24 threaded on to the shaft. The opposite ends of connector links 22 are secured to the respective springs loop 21 and the eye bolt by transversely extending bolts 25. It will be noted that the connector links 22 are formed with a plurality of aligned apertures 26 disposed in longitudinally spaced relationship. These links 22 enable the spring 18 to be subjected to a certain degree of increased tensioning. It will also be noted that the tension spring 18 is of a helicaly coiled rod construction in this embodiment.

Since the tubular strut 11 in this embodiment is fabricated from a PVC plastic it is not rigidly secured to the support assembly 12. The first end 15 of the strut tube merely rest against the support assembly and is held in position by the tension spring 18. That spring 18 applies a clamping force when it is fully retracted into the tube 14. The spring 18 is secured at it's second end 20 to a blocking element 27 which is held against the tube 14 by the spring when the apparatus is in it's normal position. When the spring 18 is extended and pulled outwardly the blocking element 27 no longer exerts a holding force against the tube 14. At this time the tube 14 is held upwardly by a support connecter 28 comprising a link—type chain having one end secured to the support assembly a distance above the point of contact of the strut 11 against the support assembly 12. The opposite end of this support connecter 28 is secured to the strut's tube 14 by a circular band 29. This band is fixed to the tube 14 to be maintained in a fixed position at approximately it's midpoint. This support connector 28 is of a length to maintain the strut in a horizontal position all though it will permit the strut to be swung upperwardly to a certain degree since the tube 14 is not fixed to the support assembly 12.

The blocking element 27 includes stop means 30 which comprises an elongated rod 31 having screw threads 32 formed on one end. It has a loop 33 formed at it's opposite end. The rod extends through a horizontally disposed ring 34 which is integrally formed with the tension spring 18 at it's second end 20. Positioned on the rod 31 at opposite sides of ring 34 are respective plates 35 which are formed with centrally disposed apertures 36 through which the rod 31 extends. These plates 35 are of a size that, in a plane oriented transversely to the longitudinal axis of the rod 30, is greater than the spring's ring 34. The plates 35 are not greater in diameter than the interior of the tube although they could be. A nut 37 is threaded onto the rod 31 to a point where it clamps the plates against the ring 34 and then clamps this combination against the rod's loop 33.

Pivotally interconnected to the rod's loop 35 is the hook 13. The hook comprises an elongated shank 38 having a first end 39 formed with an aperture which is coupled with the loop 33. This enables the hook to swing in an arc which is located in a plane that is parallel to the longitudinal axis of the strut 11 with the rod's loop 33 also being disposed in a plane that is parallel to the axis of the tension spring 18 and it's associated strut's tube 14. The hooks shank 38 is formed from a steel plate which extends downwardly to a second end 40 which is configured as a U-shaped loop 41 having a leg 42 extending in parallel relationship to the shank 28. This U-shaped loop 41 is of a size to receive the boat's rail R and retain it in engagement therewith to effect retention of the boat B during a docking operation. The U-shaped loop 41 is oriented as shown in FIG. 2 so that it will be able to grip the rail R as shown in FIG. 1. Applied to the second end 40 of the shank 38 and the leg 42 is a cushioning material 43, which in this embodiment is a fabric type tape, that provides protection for the boat's rail R as it must slide over the rail during a docking operation.

A flexible limit connector 44 is provided to mechanically limit the extent to which the tension spring 18 may be pulled out of the strut's tube 14. This connector has a loop 44a formed at it's one end and is placed in engagement with the screw eye 28*a* to which the support connector 28 is also connected. This screw eye as shown in FIG. 2 is attached to the strut support assembly 12 having a threaded end 28*b* extending through the wall of that assembly 12 and is secured thereto by a nut 28*c*. The opposite end of the flexible limit connector 44 is attached to a hook assembly 45 that is attached to a connector plate 46 secured to the upper end of the rod 31 by a nut 47 threaded on to that rod. That connector plate is formed with an extension 46*a* having an aperture (not shown) with which the hook assembly 45 is coupled. To avoid having the connector 44 droop excessively, this connector is coiled into two or more over-lapping loops 48 at approximately it's midpoint. These loops 48 are secured together by a break away connector band 49. When the tension spring 18 is extended outwardly a predetermined distance, the band will break allowing the flexible limit connector to further extend along with the tension spring 18 but will ultimately limit it's extension. This connector 44 is fabricated from a steel wire or a braided steel cable.

The strut support assembly 12 comprises an elongated C-shaped channel 50 having an elongated U-shaped channel 51 integrally formed at the mid-point of the outer vertical wall 52 of the C-shaped channel 50. Formed with the wall at each opposite side is an L-shaped end wall 53 that extends the length of the channel 51. The L-shaped wall 53 has a terminating leg 54 spaced a distance from the vertical wall 52 in parallel relationship. This c-shaped channel 50 is dimensioned to enable it to be slid longitudinally onto the post P of a dock D.

Positioned at approximately the vertical midpoint of the strut support assembly 12 is an attachment means 55 adapted to secure the support assembly at a selected vertical position on the post P. This attachment means 55 comprises a clamping element 56 and a locking component 57. The attachment means 55 includes a lock eye bolt 58 which is also secured to the U-shaped channel 51 by a pair of nuts 59. The clamping element 56 includes an eye bolt 60 having a straight rod shaped portion 61 having a threaded end which screws into a connector shaft 62 provided with a clamping pad 63 at it's one end. This clamping pad is adapted to engage surface of a dock post P. The rod shaped portion 61 extends through the channel 51 and is provided with a stop element 64 that is positioned to be in contacting engagement with the interior surface 65 of the U-shaped channel 51. Rotation of the eye bolt results in threading of the rod 61 into the connector shaft 62 and advances pad 63 into contacting engagement with a surface of the dock post P thereby effecting clamping of the support assembly 12 in a selected position. Locking of the eye bolt 58 in the clamping position is effected by a lock device 66 having a shackle 67 which extends through a securing eye bolt 58. This securing eye bolt is fastened to the U-shaped channel 51 at a location a slight distance above the lock eye bolt 60. The spacing between these two eye bolts is designed to accommodate the shackle when effecting locking of the support assembly to the dock post P.

It is advantageous to have the cushioning material 43 formed from a material that is of the visually distinctive color to facilitate the boat operator observing it's location during a docking operation. Alternatively, the cushioning material may be painted with an appropriate colored paint.

Functioning of the boat docking apparatus 10 is best seen with reference to FIG. 1. The operator maneuvers the boat B as it approaches dock D to bring the bow into close proximity the hook 13 of the apparatus to effect engagement of the boat's rail R with hook 13. After initial contact of the rail with the hooks shank 38, continued movement of the boat towards the dock will result in the rail causing the hook to swing inwardly and then slide over the rail. When the boat is sufficiently close to the dock, the hook 13 will then drop downwardly to it's usual vertical position. The operator then terminates operation of the boat's drive system and proceeds with mooring of the boat's stern by connecting a line L to the docks cleat C and the cleat C2 on the stern of the boat.

It is at this point where the operator, if acting alone, may experience difficulty in completing mooring of the boat. With a boat that is of a length of the order of 26 feet and having a cockpit-cabin, the operator must traverse a substantial distance to move along the dock from the boat's stern to the bow. Without this apparatus the boat's bow may move a distance away from the dock to a position where the operator cannot reach the rail and hold the boat in a position where it will be possible to extend a second mooring line L2 from either another cleat on the dock or the dock post while stepping on to the bow surface and connecting that line to the cleat C3 on the bow of the boat. However, with this docking apparatus the U-shaped loop 41 of the hook will engage the rail R. The tension spring 18 may be extended enabling the bow to move further outwardly from the dock but will be functioning to restrict movement and will be able to bring the bow back towards the dock. This enables the operator to possibly reach the bow rail R and bring the boat sufficiently close to the dock to permit stepping onto the bow with the line L2 and to connect it to the cleat C3.

Depending upon how far the bow has drifted away from the dock, the operator may grasp the flexible limit connector 44 and bring the boat closer to the dock. This connector will ultimately limit displacement of the bow away from the dock. It is important to limit such displacement as it is desirable to avoid having the boat contact a boat moored at an adjacent dock and possibly causing damage to either one or both of the boats.

Figure 5:
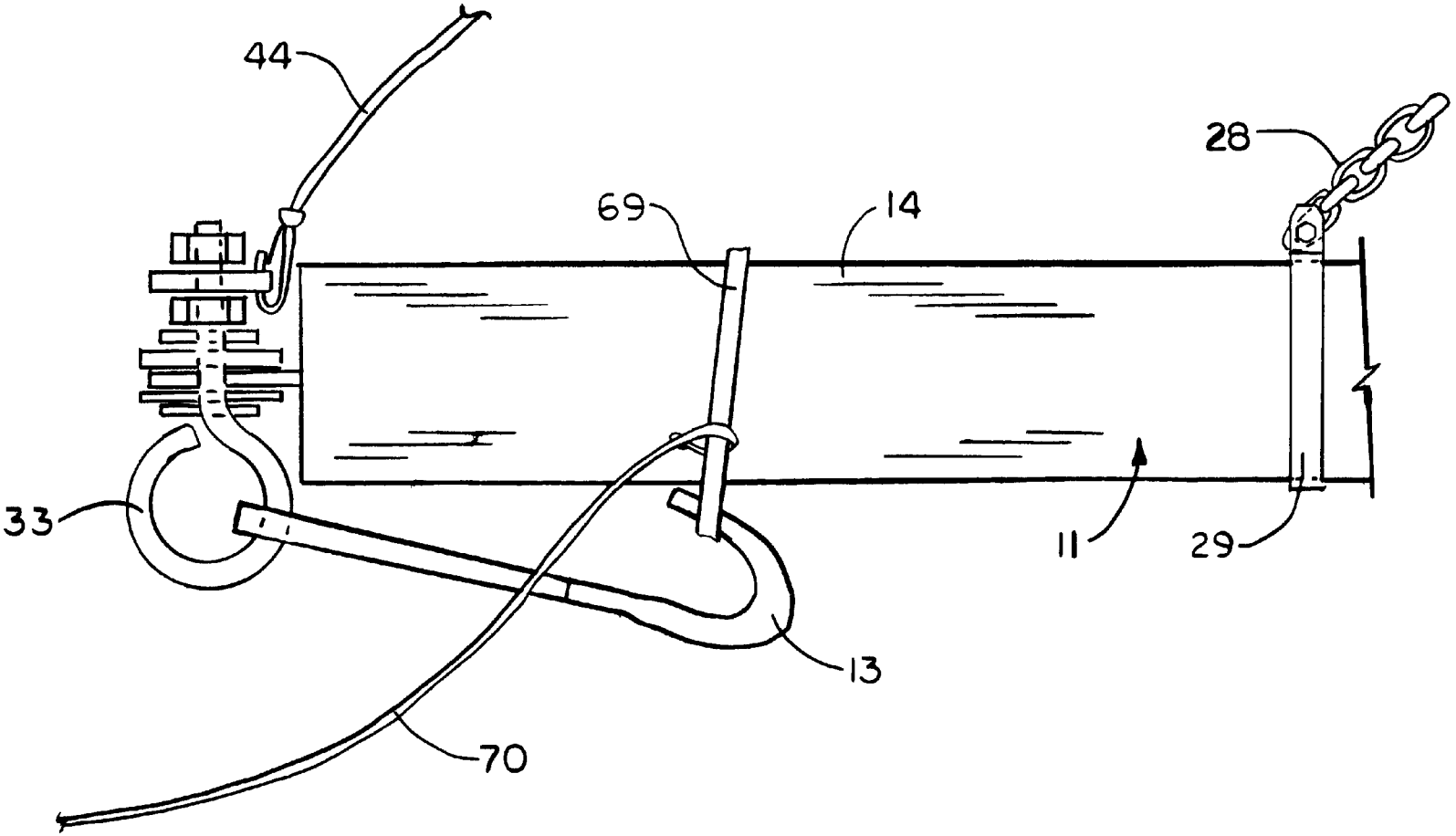
FIG. 5 is a fragmentary elevational view of the outer end portion of the strut with the hook in a retained position adjacent the bottom of the strut.

Departure of the boat from the dock may also be readily accomplished using this apparatus. To do so the hook 13 is first swung upwardly to lie substantially parallel to the tube 14 of the elongated strut 11. When in this position, a retention element 69 is placed around the adjacent portions of the hook 13 and the tube 14 as shown in FIG. 5. This retention element is designed to be removed from an operative position thereby enabling the hook to swing downwardly to a vertical position in preparation for a subsequent docking operation. Removal of the retention element 69 is effected by a line 70 which is secured to the retention element and to the front of the bow rail on the boat. The retention element 69 in this embodiment is a rubber band which can be broken without without application of a large force. The force is provided by the boat moving away from the dock and transmitting a breaking force through the line 70.

It will be readily apparent that the boat docking apparatus of this invention thus greatly assists in a boat's operator independently accomplishing the boat mooring operation. The apparatus accomplishes retention of the bow without unduly exerting stress on the boat rail that could result in damage. Operation is automatic. Also, the apparatus enables the boat to be subsequently operated in leaving the dock.

What is claimed is:

1. Boat docking apparatus for assisting in mooring of a boat in parallel relationship to a dock, the boat having a side rail supported in elevated relationship above the boat's deck structure and extending a distance adjacent the boat's side at its bow section, said apparatus comprising A. an elongated strut adapted to extend a distance laterally outward from the dock in a substantially horizontal plane at an elevation above the surface of the body of water in which the boat is being operated and be positioned a predetermined distance above the boat's rail, said strut having first and second ends;

B. a strut support assembly adapted to be mounted on a support element secured to the dock, said strut having its first end secured to said support assembly in laterally extending relationship thereto and projecting over the water; and C. a hook carried by said strut at its second end for removable engagement with the boat's rail to thereby enable said apparatus to restrict movement of the boat's bow away from the dock to a limited distance, said hook having an elongated, substantially straight shank with first and second ends, said shank's first end secured to said strut at it's second end by means maintaining said shank in spaced relationship to said second end and it's second end terminating in a U-shaped loop having a leg disposed in spaced relationship to the opposite portion at a sufficient distance to enable the boat's rail to pass through the loop's open end and be retained in the loop, said leg extending a short distance relative to the shank, said shank's first end being pivotally connected to the second end of said strut with the hook normally disposed in a downwardly extending relationship thereto, said hook being oriented with its shank and leg disposed in a plane extending substantially parallel to the longitudinal axis of said strut with the leg adjacent the strut.

2. A boat docking apparatus according to claim 1 wherein said strut includes an elongated tube which is open at the strut's second end and an elongated tension spring disposed interiorly of said tube in axially extending relationship, said spring having a first end secured to retainer means disposed in a fixed position adjacent said strut's first end, said spring being of a length that is substantially equal to the length of said tube and extending between said retainer means and said struts second end, spring having a second end extendable from said tube at the second end of said strut and a blocking element secured to said spring at the terminus of its second end, said blocking element being of a size and configuration preventing its entering into said strut.

3. A boat docking apparatus according to claim 2 wherein said blocking element comprises stop means preventing its entrance into said strut.

4. A boat docking apparatus according to claim 3 wherein said stop means includes two rigid plates disposed in spaced parallel relationship and engaging therebetween a generally circularly shaped ring formed at the second end of said spring, said stop means having an elongated rod threaded at one end and a loop formed at the opposite end, said rod extending transversely through and said spring's ring with it's loop in contacting engagement with one of said plates, said plates being clamped to said spring's ring by a nut threaded onto the aforesaid threaded end of said rod, said rod with its loop being of a length greater than the internal diameter of said strut.

5. A boat docking apparatus according to claim 4 wherein said hook is secured at the first end of its shank to said stop means loop.

6. A boat docking apparatus according to claim 2 wherein said spring is fixed to said strut support assembly in pivotable relationship permitting swinging movement of said strut in a vertical plane.

7. A boat docking apparatus according to claim 2 including an elongated strut support connector having respective opposite first and second ends, said connector's first end secured to said strut support assembly at a distance above the point of engagement of said struts first end with said strut support assembly and the connector's second end secured to said strut a distance axially outward from said strut support assembly whereby said strut is supported horizontally.

8. A boat docking apparatus according to claim 7 wherein said strut support connector is flexible thereby enabling said strut to pivot about the point of contact of it's first end with said strut support assembly either in a horizontal plane or upwardly.

9. A boat docking apparatus according to claim 2 including an elongated, flexible limit connector for limiting the distance to which said spring can be extended, said limit connector having respective first and second ends with said first end secured to said strut support assembly and said second end secured to said blocking element attached to the second end of said spring, said limit connector being of a length to permit said spring to be pulled from said strut's tube to only a predetermined maximum extent.

10. A boat docking apparatus according to claim 9 wherein said limit connector includes a portion that is normally coiled upon itself to reduce it's overall length between it's first and second ends when said spring is not extended out of said strut beyond a predetermined length.

11. A boat docking apparatus according to claim 10 wherein said limit connector's coiled portion is releasably maintained in the coiled configuration by breakaway means which is broken when a force is applied to said spring causing it to extend from said strut more than said predetermined length with said limit connector then functioning to limit the extent to which said spring may be extended from said strut thereby limiting the distance to which the boat's bow can be displaced from the dock and enabling the person performing the mooring operation to draw the bow back toward the dock to a position where the person can grasp the rail.

12. A boat docking apparatus according to claim 1 wherein said strut support assembly includes an elongated first channel shaped section having an interior shape of a size and configuration to be slideable axially on an elongated post of the dock to which a boat is to be moored, and a clamping element which can be actuated to secure the support assembly to a dock post at a fixed location.

13. A boat docking apparatus according to claim 12 having a locking component for securing said apparatus to a dock post.

14. A boat docking apparatus according to claim 1 wherein the second end of said hook is covered with a cushioning material for minimizing destructive abrading.

15. A boat docking apparatus according to claim 1 wherein the strut is a hollow tube and includes a tension spring extending axially through said tube, said hook being secured to the outer end of said spring.

* * * * *